United States Patent [19]

Brown et al.

[11] B 3,992,126

[45] Nov. 16, 1976

[54] TURBINE COOLING

[75] Inventors: Henry B. Brown, Manchester; Eugene Cantor, Glastonbury; Francis L. DeTolla, Vernon; Gary J. Vollinger, Simsbury, all of Conn.

[73] Assignee: United Technologies Corporation, Hartford, Conn.

[22] Filed: Mar. 25, 1975

[21] Appl. No.: 561,712

[44] Published under the second Trial Voluntary Protest Program on February 17, 1976 as document No. B 561,712.

[52] U.S. Cl. ..... 415/115; 415/136; 415/217

[51] Int. Cl.[2] ..... F01D 5/18

[58] Field of Search ..... 415/115, 116, 117, 136, 415/137, 138, 217

[56] References Cited

UNITED STATES PATENTS

| | | | |
|---|---|---|---|
| 2,427,244 | 9/1947 | Warner | 415/136 |
| 3,423,071 | 1/1969 | Noren | 415/217 |
| 3,730,640 | 5/1973 | Rice et al. | 415/217 |
| 3,781,125 | 12/1973 | Rahaim et al. | 415/115 |
| 3,836,279 | 9/1974 | Lee | 415/115 |

FOREIGN PATENTS OR APPLICATIONS

| | | | |
|---|---|---|---|
| 200,056 | 11/1955 | Australia | 415/217 |
| 590,506 | 1/1960 | Canada | 415/115 |

*Primary Examiner*—Henry F. Raduazo
*Attorney, Agent, or Firm*—Robert C. Walker

[57] ABSTRACT

Apparatus for cooling the nozzle guide vanes in the turbine section of a gas turbine engine is disclosed. A plurality of guide vanes is cantilevered from the turbine case and extends radially inward across the path of working medium gases flowing through the turbine. A ring which is deformable in response to pressure forces is disposed between the vanes and the turbine case forming an annular chamber from which air is metered to the vanes during operation of the engine for cooling. In one embodiment platform cavities and airfoil cavities are alternately disposed between the vanes and the ring to isolate airfoil cooling air from platform cooling air.

6 Claims, 3 Drawing Figures

TURBINE COOLING

BACKGROUND OF THE INVENTION

1. Field of the Invention

This invention relates to gas turbine engines and more particularly to apparatus for cooling the nozzle guide vanes in the turbine section of the engine.

2. Description of the Prior Art

A limiting factor in many turbine engine designs is the maximum temperature of the working medium gases that can be tolerated at the inlet to the turbine. A variety of techniques is used to increase the allowable inlet temperature including the cooling of the first few sets of nozzle guide vanes and rotor blades. Such cooling is commonly accomplished with air bled from the compressor and transferred to a local area to be cooled through suitable conduit means. The cooling air is at a pressure which is sufficiently high to permit the air to flow into the local area of the turbine without auxiliary pumping and at a temperature sufficient to provide the required cooling.

Impingement cooling is one of the more effective techniques used in cooling the turbine. In this type of cooling relatively high pressure air is passed through a multiplicity of orifices in a plate which is adjacent to the surface to be cooled causing jets of air to impinge upon local areas of the surface. The cooling rate in any local area is higher than that obtainable with conventional convective cooling thereby permitting exposure of the cooled components to higher gas temperatures without adversely effecting their durability.

Sufficiently high impingement velocities are obtainable with pressure differentials of the cooling air across the plate which are typically within the range of 20 to 70 pounds per square inch. Because of the substantial pressure differential a continuing problem in such constructions is the premature leakage of cooling air from the supply conduit means before the air can be discharged against the part to be cooled.

Considerable technical effort has been directed to the design of coolable components which minimize the potential for cooling air leakage. In U.S. Pat. No. 3,362,681 to Smuland apparatus which isolates the cooling flow to the nozzle guide vanes in the turbine section of an engine is shown. An arcuate plenum chamber is formed at the base of a plurality of integrally formed guide vanes. Cooling air supplied to the chamber is flowed to each of the vanes in the unit to cool the respective vane. The substantial premature leakage of cooling air between platforms of adjacent vanes is eliminated by the integrally formed construction of Smuland. In an engine, however, the vanes are exposed to extremely hot local gases which cause the blades to wear and ultimately requires that the blades be periodically replaced. When this happens the integrally formed construction is unattractive as compared to a vane construction which permits the replacement of each vane individually according to local wear and deterioration.

In order to take advantage of the maintenance features of the individual vane construction, means must be devised to prevent the premature leakage of cooling air between the adjacent vanes. Numerous attempts have been made in the past to establish a mechanical seal between the vanes at that location but they have been only partially effective in reducing the amount of leakage. The amount of cooling flow lost across the mechanical seal increases substantially in proportion to the pressure differential between the cooling air supply and the local working medium gases. It is apparent that where impingement cooling techniques are utilized this pressure differential will be great and the associated losses will be significant.

Overall engine performance can be increased by reducing the amount of cooling flow. Accordingly, continuing efforts are underway to treat the problem of cooling air leakage in an effective manner while maintaining or increasing the standards of component durability.

SUMMARY OF THE INVENTION

A primary object of the present invention is to improve the performance and durability of a gas turbine engine through judicious use of cooling air to the guide vanes of the turbine nozzle.

According to the present invention, an air chamber is formed in a gas turbine engine between the case and an annular ring which is, in operative response to pressure within the chamber, deformable against a plurality of guide vanes which are disposed around the inner circumference of the ring and extend radially inward across the path of working medium gases flowing through the turbine section of the engine.

In accordance with one specific embodiment, a plurality of platform cavities which are at relatively low pressure and airfoil cavities which are at relatively high pressure are alternately formed circumferentially about the engine at a position radially inward of the air chamber; the ring deforms during operation of the engine against ribs which extend from each guide vane in an axially oriented direction.

A principal feature of the present invention is the ring which is trapped between the turbine case and the vanes to form a cooling air chamber. In one embodiment flow metering orifices in the ring communicatively join the chamber to the platform and airfoil cavities which are alternately disposed circumferentially about the engine at the base of the vanes. The cavities are formed by a pair of axial sealing ribs which extend from each vane to the ring. The metering orifices are sized to provide relatively low pressure air to the platform cavities and relatively high pressure air to the airfoil cavities during operation of the engine.

A principal advantage of the present invention is a reduction in the loss of cooling air due to leakage between the platforms of adjacent vanes. The platform cavity pressure is only slightly above the pressure of the working medium but is sufficient to prevent the circulation of working medium gases below the vane platforms. Higher pressure cooling air is confined to airfoil cavity where a substantial flow of air at elevated pressures is required to cool the vane.

The foregoing, and other objects, features and advantages of the present invention will become more apparent in the light of the following detailed description of the preferred embodiment thereof as shown in the accompanying drawing.

DETAILED DESCRIPTION OF THE PREFERRED EMBODIMENT

Figure 1:
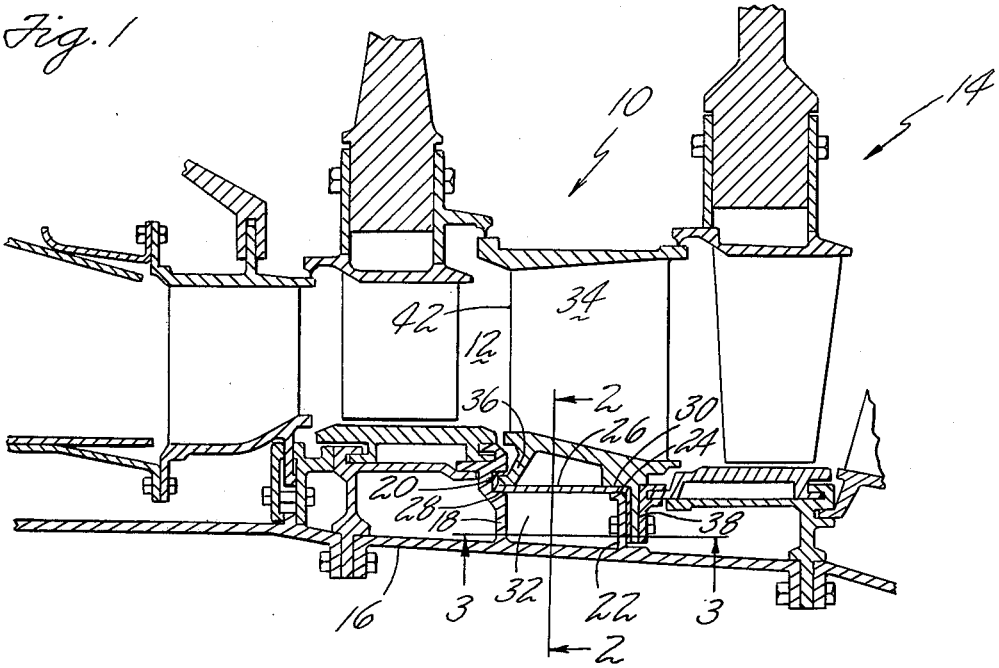
FIG. 1 is a cross-sectional view of a portion of the turbine section of a gas turbine engine showing a coolable nozzle assembly.

A portion of a gas turbine engine is shown in cross section in FIG. 1. A turbine nozzle assembly 10 is disposed within the working medium flowpath 12 immediately upstream of a wheel assembly 14. The nozzle assembly includes a turbine case 16 which has extending therefrom an upstream internal rail 18 including an outwardly facing circumferential surface 20 and a downstream internal rail 22 including an inwardly facing circumferential surface 24. A ring 26 which is deformable and has a U-shaped upstream portion 28 engages the circumferential surface 20 of the upstream rail. A downstream portion 30 of the ring 26 concentrically opposes the circumferential surface 24 of the downstream rail. The case 16 and the ring 26 define a cooling air chamber 32 located therebetween. A nozzle guide vane 34 has an arcuate hook 36 which engages the upstream rail 18 and a downstream flange 38 which is attached to the downstream rail 22. A plurality of guide vanes 34 are circumferentially disposed inward of the case at the location shown completing the construction of the nozzle assembly 10.

Figure 3:
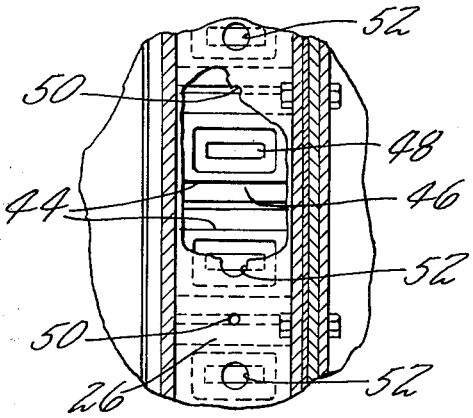
FIG. 3 is a sectional view taken along the line 3—3 as shown in FIG. 1 which is partially broken away to show the undersides of the nozzle guide vanes.
Figure 2:
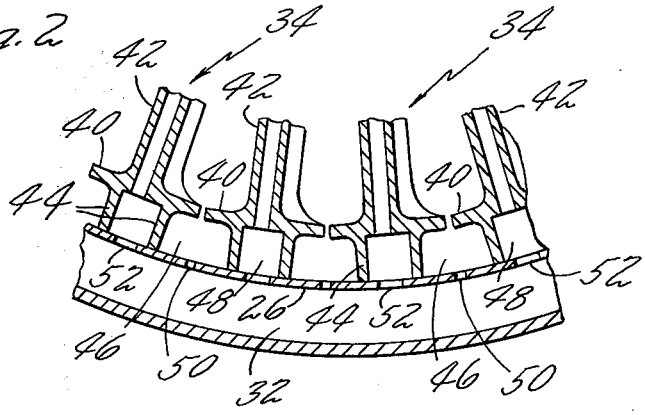
FIG. 2 is a sectional view taken along the line 2—2 as shown in FIG. 1.

As is shown in FIG. 2 each vane has a platform section 40 and an airfoil section 42. A pair of ribs 44 extend radially between each vane platform section 40 and the deformable ring 26 and form an airfoil cavity 48. Between each pair of adjacent vanes is a platform cavity 46. The deformable ring 26, as is shown in FIG. 2 and in FIG. 3, has a plurality of platform orifices 50 and a plurality of airfoil orifices 52 which communicatively join the platform and the airfoil cavities respectively to the air chamber 32.

The air chamber 32 has an annular shape which extends circumferentially about the centerline of the engine. Cooling air is supplied to the chamber by conduit means which are not shown. One common source of the cooling air is the exit region of the compressor where the air is at a sufficiently high pressure to be flowable into the turbine. In such an embodiment the pressure of the cooling air and the pressure of the working medium gases at the leading edge of the vane during takeoff are on the order of 210 and 165 pounds per square inch absolute respectively.

The deformable ring 26 radially separates the chamber 32 from the platform cavities 46 and the airfoil cavities 48 which are alternately spaced about the inner circumference of the chamber. As the chamber is pressurized the ring deforms against the ribs 44 to establish an air seal between adjacent platform and airfoil cavities. Although the ring may be segmented in some embodiments, a full ring eliminates the possibility of air leakage between adjacent segments and is preferred. In one embodiment the ring has a plurality of airfoil orifices 52 and platform orifices 50 which communicatively join the airfoil cavities and platform cavities respectively to the chamber. A ring formed from sheet metal having a thickness within the range of fifteen to twenty-five thousandths of an inch may be used depending upon the pressure differential across the ring. In one embodiment the pressure differential and the ring thickness are approximately 10 pounds per square inch and seventeen thousandths of an inch respectively.

Circumferential sealing contact between the U-shaped upstream portion 28 of the deformable ring 26 is maintained with the outwardly facing circumferential surface 20 of the upstream rail 18 by pressure forces exerted by the working medium on the vane airfoil sections 42 which tend to rotate the vanes about the downstream rail 22 during operation of the engine.

Each airfoil cavity 48 extends radially into the airfoil section 42 of the respective nozzle guide vane 34. The cooling air is flowed from the air chamber 32 to the airfoil cavities through the airfoil orifices 52. Although not specifically shown, the cooling flow may be discharged from the cavities to the working medium flowpath 12 or any adjacent region of sufficiently low pressure.

Each platform cavity 46 lies between adjacent nozzle guide vanes 34 and is pressurized to prevent the circulation of working medium gas beneath the platforms 40. The pressure within the platform cavities need be only slightly higher than the local pressure of the working medium gases to prevent recirculation. Accordingly, platform orifices 50 in one embodiment are sized to admit only limited amounts of cooling air to the platform cavities in order to prevent excessive leakage of air between adjacent platforms. In alternative embodiments the platform cavities are supplied with relatively low pressure air from any suitable source and may incorporate a mechanical type sealing means between the vanes.

Those skilled in the art will recognize that the alternating platform and airfoil cavity construction of the present invention is particularly advantageous where impingement cooling of the guide vanes is employed. As has been discussed above, a substantial pressure differential is required between the cooling air and the working medium gases in order to accelerate the air to impingement velocities. If this same pressure differential were applied between adjacent vanes substantial leakage would occur and performance would be reduced. Regardless of the precise construction, the important feature to be realized is that two cooling pressures and even two cooling air sources can be advantageously utilized in the guide vane region to minimize the wasteful leakage of cooling air.

Although the invention has been shown in one preferred embodiment at the location of the second stage vanes, it should be understood by those skilled in the art that many of the concepts shown are equally applicable to any coolable turbine stage. Additionally, it should be noted that other various changes and omissions in the form and detail thereof may be made therein without departing from the spirit and the scope of the invention.

Having thus described a typical embodiment of our invention, that which we claim as new and desire to secure by letters Patent of the United States is:

1. In the turbine nozzle assembly of a gas turbine engine, the combination comprising:

a case which radially encloses a portion of the turbine section of the engine and which has an upstream rail extending radially inward from the case including an outwardly facing surface which extends about the full circumference of the engine, and a downstream rail extending radially inward from the case including an inwardly facing surface which extends about the full circumference of the engine;

a deformable ring which concentrically opposes the circumferential surface of the upstream rail and a downstream portion which concentrically opposes the circumferential surface of the downstream rail to form the cooling air chamber between the deformable ring and the case; and a plurality of hollow nozzle guide vanes, each vane having a hook which engages the upstream rail of the case with the deformable ring disposed therebetween, a downstream flange which is attached to the downstream rail of the case with the downstream portion of the deformable ring trapped therebetween, and a pair of ribs which extend axially between the hook and the flange with one rib on each side of the hollow portion of the vane forming an airfoil cavity therebetween which is in gas communication with the hollow portion of the vane and forming a platform cavity between the ribs of each pair of adjacent vanes.

2. The invention according to claim 1 wherein said ring is deformable against the ribs to maintain an air seal between adjacent platform and airfoil cavities in operative response to pressure within the cooling air chamber.

3. The invention according to claim 1 wherein said ring is deformable against the circumferential surface of the upstream rail of the case in operative response to pressure forces exerted by the working medium on the guide vanes.

4. The invention according to claim 2 which further includes means for supplying cooling air to the platform cavities and means for supplying cooling air to the airfoil cavities.

5. The invention according to claim 4 wherein the platform cavity supply means is adapted to maintain an air pressure within the platform cavities which is lower than the pressure of the air within the airfoil cavities.

6. A turbine nozzle assembly for a gas turbine engine, which includes:

a case which radially encloses a portion of the turbine section of the engine and which has an upstream rail extending radially inward from the case including an outwardly facing surface which extends about the full circumference of the engine, and a downstream rail extending radially inward from the case including an inwardly facing surface which extends about the full circumference of the engine;

a deformable ring having a U-shaped upstream portion which engages the circumferential surface of the upstream rail and a downstream portion which concentrically opposes the circumferential surface of the downstream rail to form the cooling air chamber between the ring and the case; and a plurality of hollow nozzle guide vanes, each vane having a hook which engages the upstream rail of the case with the deformable ring disposed therebetween, a downstream flange which is attached to the downstream rail of the case with the downstream end of the ring trapped therebetween, and a pair of ribs which extend axially between the hook and the flange, said ring being deformable against the pair of ribs in operative relation to pressure within the chamber to form alternating platform and airfoil cavities which are respectively in communication with the chamber through platform and airfoil orifices in said ring, the orifices being sized to provide a lower pressure in the platform cavities than in the airfoil cavities during operation of the engine.

* * * * *